US008502477B2

(12) United States Patent
Sadwick et al.

(10) Patent No.: US 8,502,477 B2
(45) Date of Patent: Aug. 6, 2013

(54) DIMMABLE POWER SUPPLY

(75) Inventors: Laurence P. Sadwick, Salt Lake City, UT (US); Neil J. Barabas, Chatsworth, CA (US)

(73) Assignee: InnoSys, Inc, Salt Lake City, UT (US)

( * ) Notice: Subject to any disclaimer, the term of this patent is extended or adjusted under 35 U.S.C. 154(b) by 0 days.

(21) Appl. No.: 13/404,514

(22) Filed: Feb. 24, 2012

(65) Prior Publication Data

US 2012/0153869 A1 Jun. 21, 2012

Related U.S. Application Data

(63) Continuation of application No. 12/422,258, filed on Apr. 11, 2009, now Pat. No. 8,148,907.

(51) Int. Cl.
*H05B 37/02* (2006.01)

(52) U.S. Cl.
USPC ..... 315/308; 315/246; 315/287; 315/360

(58) Field of Classification Search
USPC .. 315/246, 287, 291, 307, 308, 360; 323/265, 323/282
See application file for complete search history.

(56) References Cited

U.S. PATENT DOCUMENTS

| | | | | |
|---|---|---|---|---|
| 4,629,944 | A | 12/1986 | Maytum et al. | |
| 4,914,356 | A * | 4/1990 | Cockram | 315/307 |
| 5,404,080 | A * | 4/1995 | Quazi | 315/151 |
| 5,463,280 | A * | 10/1995 | Johnson | 315/187 |
| 5,581,158 | A * | 12/1996 | Quazi | 315/149 |
| 5,734,564 | A | 3/1998 | Brkovic | |
| 6,081,075 | A * | 6/2000 | Littlefield | 315/209 R |
| 6,295,217 | B1 | 9/2001 | Yang et al. | |
| 6,392,368 | B1 | 5/2002 | Deller et al. | |
| 6,462,485 | B1 * | 10/2002 | Kimball | 315/169.3 |
| 6,577,512 | B2 * | 6/2003 | Tripathi et al. | 363/21.17 |
| 6,853,151 | B2 | 2/2005 | Leong | |
| 6,927,989 | B2 * | 8/2005 | Fukumoto | 363/95 |
| 6,936,968 | B2 | 8/2005 | Cross et al. | |

(Continued)

FOREIGN PATENT DOCUMENTS

| | | | |
|---|---|---|---|
| WO | WO03/096761 | A1 | 11/2003 |
| WO | WO2008/137460 | A2 | 11/2008 |

OTHER PUBLICATIONS

Supplemental European Search Report re EP10762548, Dec. 18, 2012.

(Continued)

*Primary Examiner* — Thuy Vinh Tran
(74) *Attorney, Agent, or Firm* — Hamilton, DeSanctis & Cha

(57) ABSTRACT

Various embodiments of a dimmable power supply are disclosed herein. For example, some embodiments provide a dimmable power supply including an output driver, a variable pulse generator and a load current detector. The output driver has a power input, a control input and a load path. The variable pulse generator includes a control input and a pulse output, with the pulse output connected to the output driver control input. The variable pulse generator is adapted to vary a pulse width at the pulse output based on a signal at the control input. The load current detector has an input connected to the output driver load path and an output connected to the variable pulse generator control input. The load current detector has a time constant adapted to substantially filter out a change in a load current at a frequency of pulses at the variable pulse generator pulse output.

16 Claims, 11 Drawing Sheets

U.S. PATENT DOCUMENTS

| | | | | |
|---|---|---|---|---|
| 6,965,205 | B2 * | 11/2005 | Piepgras et al. | 315/318 |
| 7,151,246 | B2 * | 12/2006 | Fein et al. | 250/208.1 |
| 7,151,345 | B2 * | 12/2006 | Sanchez | 315/308 |
| 7,161,313 | B2 * | 1/2007 | Piepgras et al. | 315/318 |
| 7,178,941 | B2 * | 2/2007 | Roberge et al. | 362/225 |
| 7,183,724 | B2 * | 2/2007 | Ball | 315/274 |
| 7,202,613 | B2 * | 4/2007 | Morgan et al. | 315/312 |
| 7,233,115 | B2 * | 6/2007 | Lys | 315/291 |
| 7,256,554 | B2 * | 8/2007 | Lys | 315/291 |
| 7,262,559 | B2 * | 8/2007 | Tripathi et al. | 315/291 |
| 7,276,861 | B1 * | 10/2007 | Shteynberg et al. | 315/291 |
| 7,295,176 | B2 | 11/2007 | Yang | |
| 7,298,095 | B2 * | 11/2007 | Nukisato et al. | 315/291 |
| 7,358,706 | B2 * | 4/2008 | Lys | 323/222 |
| 7,378,805 | B2 * | 5/2008 | Oh et al. | 315/291 |
| 7,441,922 | B2 | 10/2008 | Huang et al. | |
| 7,459,864 | B2 * | 12/2008 | Lys | 315/291 |
| 7,478,941 | B2 | 1/2009 | Wu et al. | |
| 7,511,437 | B2 * | 3/2009 | Lys et al. | 315/307 |
| 7,557,519 | B2 | 7/2009 | Kranz | |
| 7,759,881 | B1 | 7/2010 | Melanson | |
| 8,022,634 | B2 | 9/2011 | Greenfeld | |
| 8,115,421 | B2 | 2/2012 | Mishima et al. | |
| 8,148,907 | B2 | 4/2012 | Sadwick | |
| 8,203,445 | B2 | 6/2012 | Recker et al. | |
| 8,405,319 | B2 | 3/2013 | Sadwick | |
| 2003/0085669 | A1 | 5/2003 | Pak | |
| 2006/0170373 | A1 * | 8/2006 | Yang | 315/209 R |
| 2006/0220595 | A1 | 10/2006 | Lu | |
| 2007/0025119 | A1 | 2/2007 | Chang-Jien | |
| 2007/0114986 | A1 | 5/2007 | Yoshii | |
| 2007/0228999 | A1 | 10/2007 | Kit | |
| 2008/0067953 | A1 * | 3/2008 | Kranz | 315/291 |
| 2008/0081423 | A1 * | 4/2008 | Sadwick et al. | 438/288 |
| 2008/0094837 | A1 | 4/2008 | Dobbins et al. | |
| 2008/0284346 | A1 * | 11/2008 | Lee | 315/224 |
| 2008/0290814 | A1 | 11/2008 | Leong | |
| 2009/0009994 | A1 | 1/2009 | Wu et al. | |
| 2010/0026208 | A1 * | 2/2010 | Shteynberg et al. | 315/297 |
| 2010/0033095 | A1 * | 2/2010 | Sadwick | 315/51 |
| 2010/0060204 | A1 | 3/2010 | Ohtake et al. | |
| 2010/0176743 | A1 | 7/2010 | Lee et al. | |
| 2010/0194296 | A1 | 8/2010 | Park | |
| 2010/0244696 | A1 | 9/2010 | Kim | |
| 2011/0169426 | A1 | 7/2011 | Sadwick | |
| 2011/0260619 | A1 | 10/2011 | Sadwick | |
| 2012/0043893 | A1 | 2/2012 | Sadwick | |
| 2012/0299500 | A1 | 11/2012 | Sadwick | |

OTHER PUBLICATIONS

U.S. Appl. No. 13/098,768, Unpublished (filed May 2, 2011) (Laurence P. Sadwick).

U.S. Appl. No. 13/073,959, Unpublished (filed Mar. 28, 2011) (Laurence P. Sadwick).

U.S. Appl. No. 13/301,457, Unpublished (filed Nov. 21, 2011) (Laurence P. Sadwick).

Written opinion of the international searching authority re PCT/US2010/030644, Oct. 20, 2011.

* cited by examiner

DIMMABLE POWER SUPPLY

BACKGROUND

Electricity is generated and distributed in alternating current (AC) form, wherein the voltage varies sinusoidally between a positive and a negative value. However, many electrical devices require a direct current (DC) supply of electricity having a constant voltage level, or at least a supply that remains positive even if the level is allowed to vary to some extent. For example, light emitting diodes (LEDs) and similar devices such as organic light emitting diodes (OLEDs) are being increasingly considered for use as light sources in residential, commercial and municipal applications. However, in general, unlike incandescent light sources, LEDs and OLEDs cannot be powered directly from an AC power supply unless, for example, the LEDs are configured in some back to back formation. Electrical current flows through an individual LED easily in only one direction, and if a negative voltage which exceeds the reverse breakdown voltage of the LED is applied, the LED can be damaged or destroyed. Furthermore, the standard, nominal residential voltage level is typically something like 120 V or 240 V, both of which are higher than may be desired for a high efficiency LED light. Some conversion of the available power may therefore be necessary or highly desired with loads such as an LED light.

In one type of commonly used power supply for loads such as an LED, an incoming AC voltage is connected to the load only during certain portions of the sinusoidal waveform. For example, a fraction of each half cycle of the waveform may be used by connecting the incoming AC voltage to the load each time the incoming voltage rises to a predetermined level or reaches a predetermined phase and by disconnecting the incoming AC voltage from the load each time the incoming voltage again falls to zero. In this manner, a positive but reduced voltage may be provided to the load. This type of conversion scheme is often controlled so that a constant current is provided to the load even if the incoming AC voltage varies. However, if this type of power supply with current control is used in an LED light fixture or lamp, a conventional dimmer is often ineffective. For many LED power supplies, the power supply will attempt to maintain the constant current through the LED despite a drop in the incoming voltage by increasing the on-time during each cycle of the incoming AC wave.

SUMMARY

Various embodiments of a dimmable power supply are disclosed herein. For example, some embodiments provide a dimmable power supply including an output driver, a variable pulse generator and a load current detector. The output driver has a power input, a control input and a load path. The variable pulse generator includes a control input and a pulse output, with the pulse output connected to the output driver control input. The variable pulse generator is adapted to vary a pulse width at the pulse output based on a signal at the control input. The load current detector has an input connected to the output driver load path and an output connected to the variable pulse generator control input. The load current detector has a time constant adapted to substantially filter out a change in a load current at a frequency of pulses at the variable pulse generator pulse output.

In an embodiment of the dimmable power supply, the load current detector includes a comparator having a first input connected to the load path, a second input connected to a reference current source, and an output connected to the variable pulse generator control input.

In an embodiment of the dimmable power supply, the output driver also includes a current sense resistor in the load path. The first input of the comparator is connected through a low pass filter to the load path at a node of the current sense resistor. The time constant of the load current detector is based at least in part on the low pass filter.

In an embodiment of the dimmable power supply, the first input of the comparator is a non-inverting input and the second input of the comparator is an inverting input. The load current detector also includes a low pass filter connected in a negative feedback loop between the comparator output and the second input of the comparator.

In an embodiment of the dimmable power supply, the reference current source includes a voltage divider connected between the power input of the output driver and a ground. The reference current source has an output connected to the second input of the load current detector.

In an embodiment of the dimmable power supply, the voltage divider includes at least one upper resistor connected at a first end to the power input of the output driver, a transistor having an input connected to a second end of the at least one upper resistor and having an output connected to the reference current source output, and at least one lower resistor connected at a first end to a control input of the transistor and at a second end to the ground.

An embodiment of the dimmable power supply also includes a level shifter connected between the load current detector output and the variable pulse generator control input.

In an embodiment of the dimmable power supply, the level shifter comprises an optocoupler.

In an embodiment of the dimmable power supply, the output driver includes an inductor connected at a first node to a local ground and a switch connected between a second node of the inductor and a ground. The switch has a control input connected to the pulse output of the variable pulse generator. The output driver also includes a diode connected between the power input of the output driver and the second node of the inductor. The load path is located between the power input of the output driver and the first node of the inductor.

In an embodiment of the dimmable power supply, the output driver also includes a capacitor connected in parallel with at least a portion of the load path.

In an embodiment of the dimmable power supply, the load current detector includes at least one low pass filter that is referenced to the local ground.

In an embodiment of the dimmable power supply, the output driver also includes a current sensor connected between the switch and the ground. The variable pulse generator is adapted to reduce the pulse width when the current sensor detects a current level exceeding a threshold level.

In an embodiment of the dimmable power supply, the variable pulse generator includes a current limit switch connected to the current sensor. The current limit switch is adapted to reduce the pulse width in an inverse proportion to a temperature of the current limit switch.

An embodiment of the dimmable power supply includes an overvoltage limiter connected to the load current detector output. The overvoltage limiter is adapted to reduce the pulse width when a voltage level at the load current detector output exceeds a threshold level.

An embodiment of the dimmable power supply includes an internal dimming device connected to the load current detector. The load current detector and variable pulse generator are adapted to vary the pulse width based on an output of the internal dimming device.

In an embodiment of the dimmable power supply, the load current detector time constant is adapted to substantially keep the pulse width at the pulse output constant across an AC waveform at the power input of the output driver.

In an embodiment of the dimmable power supply, the output driver includes a transformer and a switch connected between the transformer and ground. The switch has a control input connected to the pulse output of the variable pulse generator. The output driver also includes a diode connected between the power input of the output driver and the transformer. The load path is located between the power input of the output driver and the transformer.

Other embodiments provide a method of dimmably supplying a load current including measuring a ratio between a reference current and a load current, producing pulses having a width that is inversely proportional to the ratio, and driving the load current with the pulses. The measuring is performed with a time constant that substantially filters out the pulses in the load current but substantially passes changes in the reference current.

An embodiment of the method of dimmably supplying a load current also includes generating the reference current based on an input voltage so that the reference current is directly proportional to the input voltage.

Other embodiments provide a power supply having an output driver with an inductor connected at a first node to a local ground, a diode connected between a power input and a second node of the inductor, a load path having a first node connected to the power input, a capacitor connected in parallel with the load path, and a load current sensor connected at a first end to the local ground and at a second end to a second node of the load path. The output driver also includes a switch having an input connected to the second node of the inductor and having an output driver control input, and a drive current sensor connected between an output of the switch and a ground. The power supply also includes a variable pulse generator having a control input and a pulse output. The pulse output is connected to the output driver control input. The variable pulse generator is adapted to vary a pulse width at the pulse output based on a signal at the control input. The variable pulse generator includes a current limit switch connected to the load current sensor. The current limit switch is adapted to reduce the pulse width in an inverse proportion to a temperature of the current limit switch. The variable pulse generator is adapted to reduce the pulse width when the drive current sensor detects a current level exceeding a threshold level. The power supply also includes a load current detector with a reference current source. The reference current source includes at least one upper resistor connected at a first end to the power input, a transistor having an input connected to a second end of the at least one upper resistor, and at least one lower resistor connected at a first end to a control input of the transistor and at a second end to the ground. The load current detector also includes a comparator having a non-inverting input connected to the second end of the load current sensor through a low pass filter and having an inverting input connected to an output of the reference current source transistor. The load current detector also includes a second low pass filter connected in a negative feedback loop between the comparator output and the inverting input. The load current detector has a time constant adapted to substantially filter out a change in a load current at a frequency on the order of a frequency of pulses at the variable pulse generator pulse output. The time constant of the load current detector is based at least in part on the low pass filter that is referenced to the local ground. The current detector is referenced to both the local ground and to the ground. The power supply also includes an optocoupler as a level shifter connected between an output of the comparator in the load current detector and the variable pulse generator control input. The power supply also includes an overvoltage limiter connected to the input of the level shifter. The overvoltage limiter is adapted to reduce the pulse width when a voltage level that appears across the load exceeds a second threshold level. The power supply also includes an internal dimming device connected to the load current detector. The load current detector and variable pulse generator are adapted to vary the pulse width based on an output of the internal dimming device.

This summary provides only a general outline of some particular embodiments. Many other objects, features, advantages and other embodiments will become more fully apparent from the following detailed description, the appended claims and the accompanying drawings.

BRIEF DESCRIPTION OF THE DRAWINGS

A further understanding of the various embodiments may be realized by reference to the figures which are described in remaining portions of the specification. In the figures, like reference numerals may be used throughout several drawings to refer to similar components.

DESCRIPTION

The drawings and description, in general, disclose various embodiments of a dimmable power supply for loads such as an LED or array of LEDs. The dimmable power supply may use either an AC or DC input, with a varying or constant voltage level. The current through the load from the dimmable power supply may be adjusted using conventional or other types of dimmers in the power supply line upstream from the dimmable power supply. Thus, the term "dimmable" is used herein to indicate that input voltage of the dimmable power supply may be varied to dim a load or otherwise reduce the load current, without the control system in the dimmable power supply opposing the resulting change to the load current and keeping the load current constant. Various embodiments of the dimmable power supply may, in addition to being externally dimmable, be internally dimmable by including dimming elements within the dimmable power supply. In these embodiments, the load current may be adjusted by controlling the input voltage of the dimmable power supply using an external dimmer and by controlling the internal dimming elements within the dimmable power supply. Internal dimming can be implemented and accomplished by, for example, among others, on/off using pulse width modulation (PWM) at appropriate frequencies, 0 to 10 V, the use of resistors including variable resistor(s), encoders, analog and/or digital resistors, or any other type of analog, digital or a mixture of analog and digital.

Figure 1:
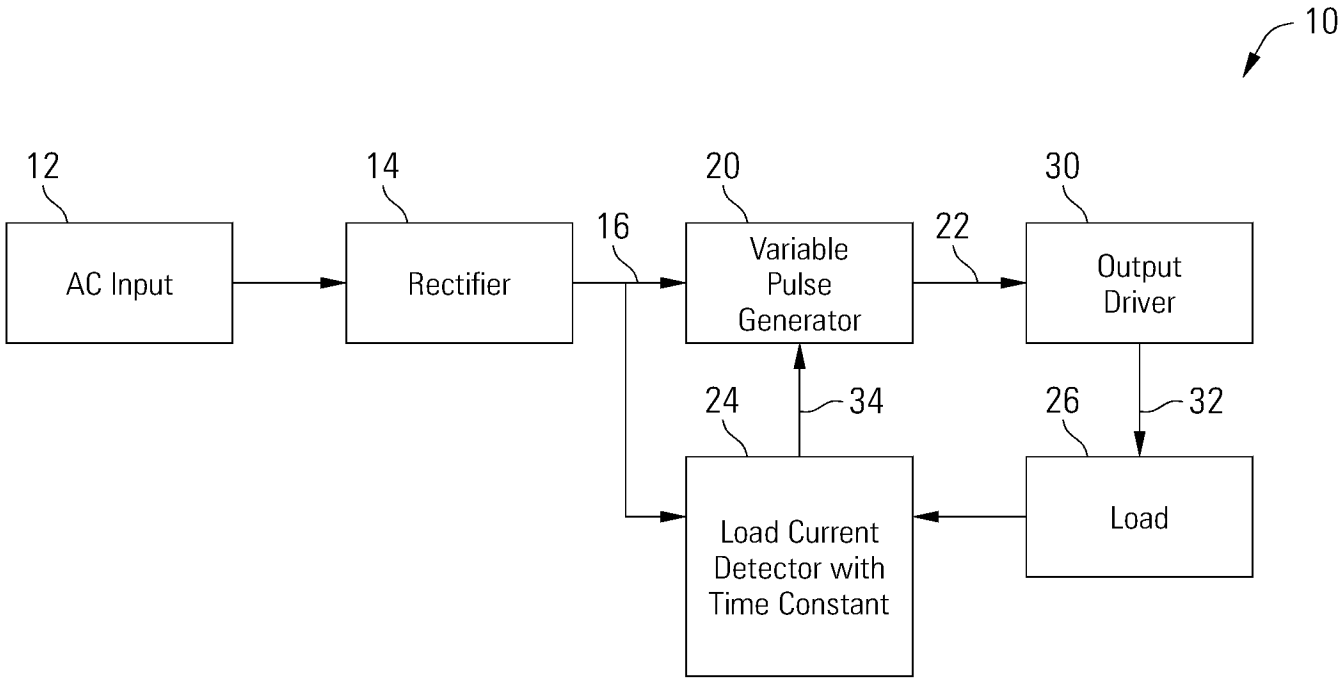
FIG. 1 depicts a block diagram of a dimmable power supply in accordance with some embodiments.

Referring now to FIG. 1, a block diagram of an embodiment of a dimmable power supply 10 is shown. In this embodiment, the dimmable power supply 10 is powered by an AC input 12, for example by a 50 or 60 Hz sinusoidal waveform of 120 V or 240 V RMS such as that supplied to residences by municipal electric power companies. It is important to note, however, that the dimmable power supply 10 is not limited to any particular power input. Furthermore, the voltage applied to the AC input 12 may be externally controlled, such as in an external dimmer (not shown) that reduces the voltage. The AC input 12 is connected to a rectifier 14 to rectify and invert any negative voltage component from the AC input 12. Although the rectifier 14 may filter and smooth the power output 16 if desired to produce a DC signal, this is not necessary and the power output 16 may be a series of rectified half sinusoidal waves at a frequency double that at the AC input 12, for example 120 Hz. A variable pulse generator 20 is powered by the power output 16 from the AC input 12 and rectifier 14 to generate a train of pulses at an output 22. The variable pulse generator 20 may comprise any device or circuit now known or that may be developed in the future to generate a train of pulses of any desired shape. For example, the variable pulse generator 20 may comprise devices such as comparators, amplifiers, oscillators, counters, frequency generators, etc.

The pulse width of the train of pulses is controlled by a load current detector 24 with a time constant based on a current level through a load 26. Various implementations of pulse width control including pulse width modulation (PWM) by frequency, analog and/or digital control may be used to realize the pulse width control. Other features such as soft start, delayed start, instant on operation, etc. may also be included if deemed desirable, needed, and/or useful. An output driver 30 produces a current 32 through the load 26, with the current level adjusted by the pulse width at the output 22 of the variable pulse generator 20. The current 32 through the load 26 is monitored by the load current detector 24. The current monitoring performed by the load current detector 24 is done with a time constant that includes information about voltage changes at the power output 16 of the rectifier 14 slower than or on the order of a waveform cycle at the power output 16, but not faster changes at the power output 16 or voltage changes at the output 22 of the variable pulse generator 20. The control signal 34 from the load current detector 24 to the variable pulse generator 20 thus varies with slower changes in the power output 16 of the rectifier 14, but not with the incoming rectified AC waveform or with changes at the output 22 of the variable pulse generator 20 due to the pulses themselves. In one particular embodiment, the load current detector 24 includes one or more low pass filters to implement the time constant used in the load current detection. The time constant may be established by a number of suitable devices and circuits, and the dimmable power supply 10 is not limited to any particular device or circuit. For example, the time constant may be established using RC circuits arranged in the load current detector 24 to form low pass filters, or with other types of passive or active filtering circuits. The load 26 may be any desired type of load, such as a light emitting diode (LED) or an array of LEDs arranged in any configuration. For example, an array of LEDs may be connected in series or in parallel or in any desired combination of the two. The load 26 may also be an organic light emitting diode (OLED) in any desired quantity and configuration. The load 26 may also be a combination of different devices if desired, and is not limited to the examples set forth herein. Hereinafter, the term LED is used generically to refer to all types of LEDs including OLEDs and is to be interpreted as a non-limiting example of a load.

Figure 2:
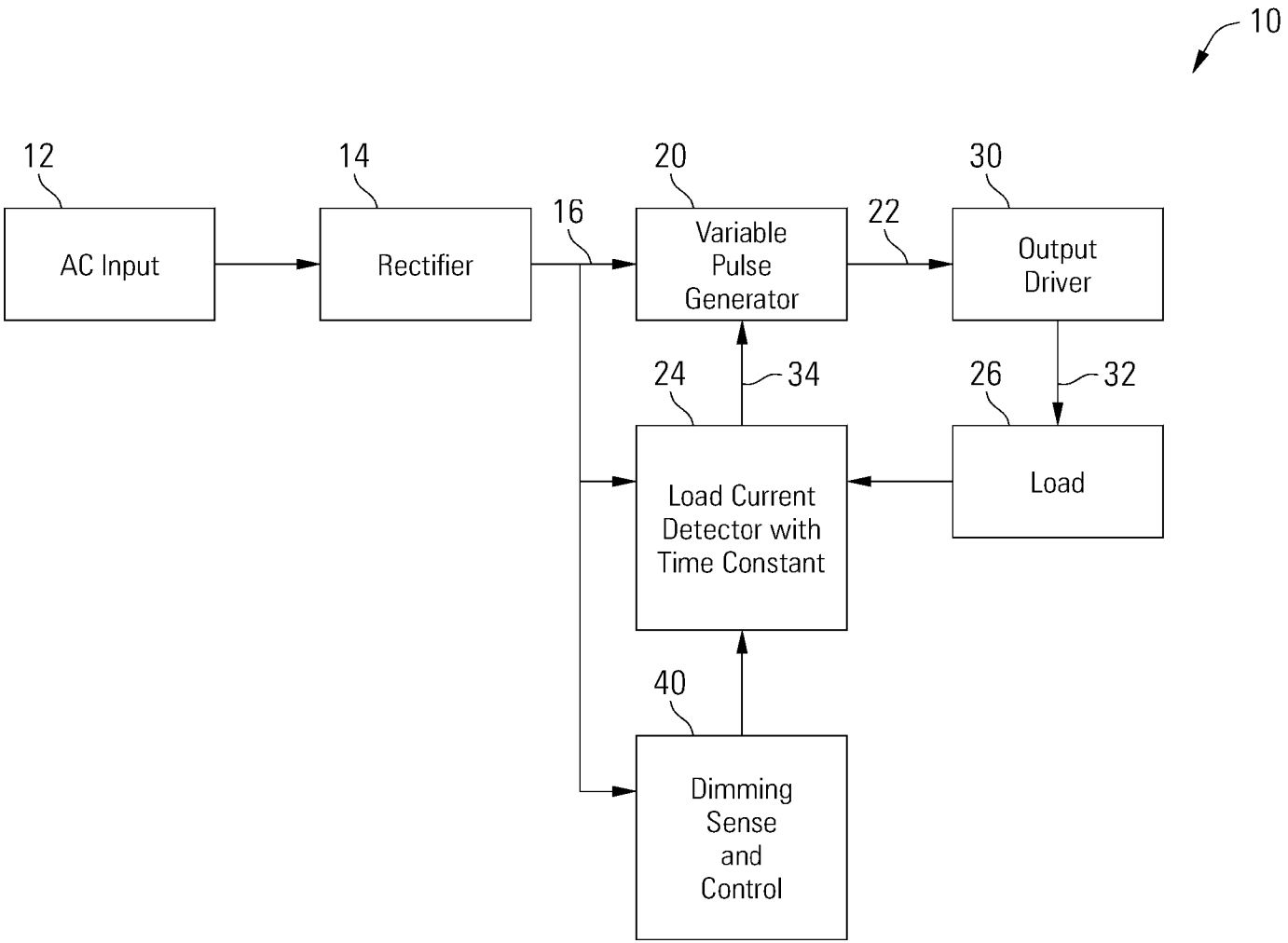
FIG. 2 depicts a block diagram of a dimmable power supply with internal dimming.

Referring now to FIG. 2, some embodiments of the dimmable power supply 10 may also include an internal dimmer 40 adapted to adjustably reduce the current 32 through the load 26 by narrowing the pulse width at the output 22 of the variable pulse generator 20. This may be accomplished in a number of ways, for example by adjusting a reference voltage or current in the load current detector 24 that is based on the power output 16 from the rectifier 14. The internal dimmer 40 may also adjust the level of a feedback voltage or current from the load 26 to narrow the pulse width and reduce the load current. The internal dimmer can also be based on pulse width modulation (PWM) and related methods, techniques and technologies.

Figure 3:
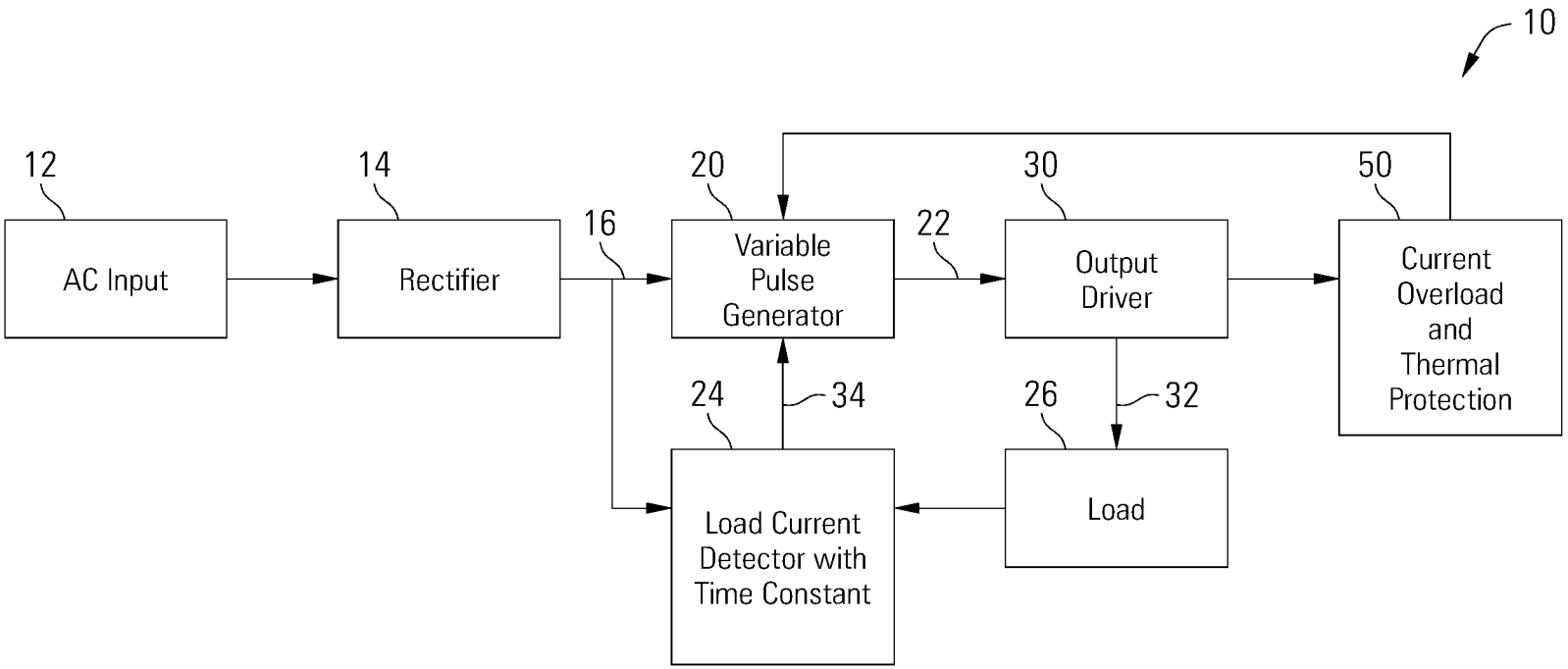
FIG. 3 depicts a block diagram of a dimmable power supply with current overload and thermal protection.

Some embodiments of the dimmable power supply 10 may include current overload protection and/or thermal protection 50, as illustrated in FIG. 3. As an example, the current overload protection 50 measures the current through the dimmable power supply 10 and narrows or turns off the pulses at the output 22 of the variable pulse generator 20 if the current exceeds a threshold value. The current detection for the current overload protection 50 may be adapted as desired to measure instantaneous current, average current, or any other measurement desired and at any desired location in the dimmable power supply 10. Thermal protection 50 may also be included to narrow or turn off the pulses at the output 22 of the variable pulse generator 20 if the temperature in the dimmable power supply 10 becomes excessive, thereby reducing the power through the dimmable power supply 10 and allowing the dimmable power supply 10 to cool. The thermal protection may also be designed and implemented such that at a prescribed temperature, the pulses are turned off which effectively disables the power supply and turns off the output to the load. The temperature sensor can be any type of temperature sensitive element including semiconductors such as diodes, transistors, etc. and/or thermocouples, thermistors, bimetallic elements and switches, etc.

Figure 4:
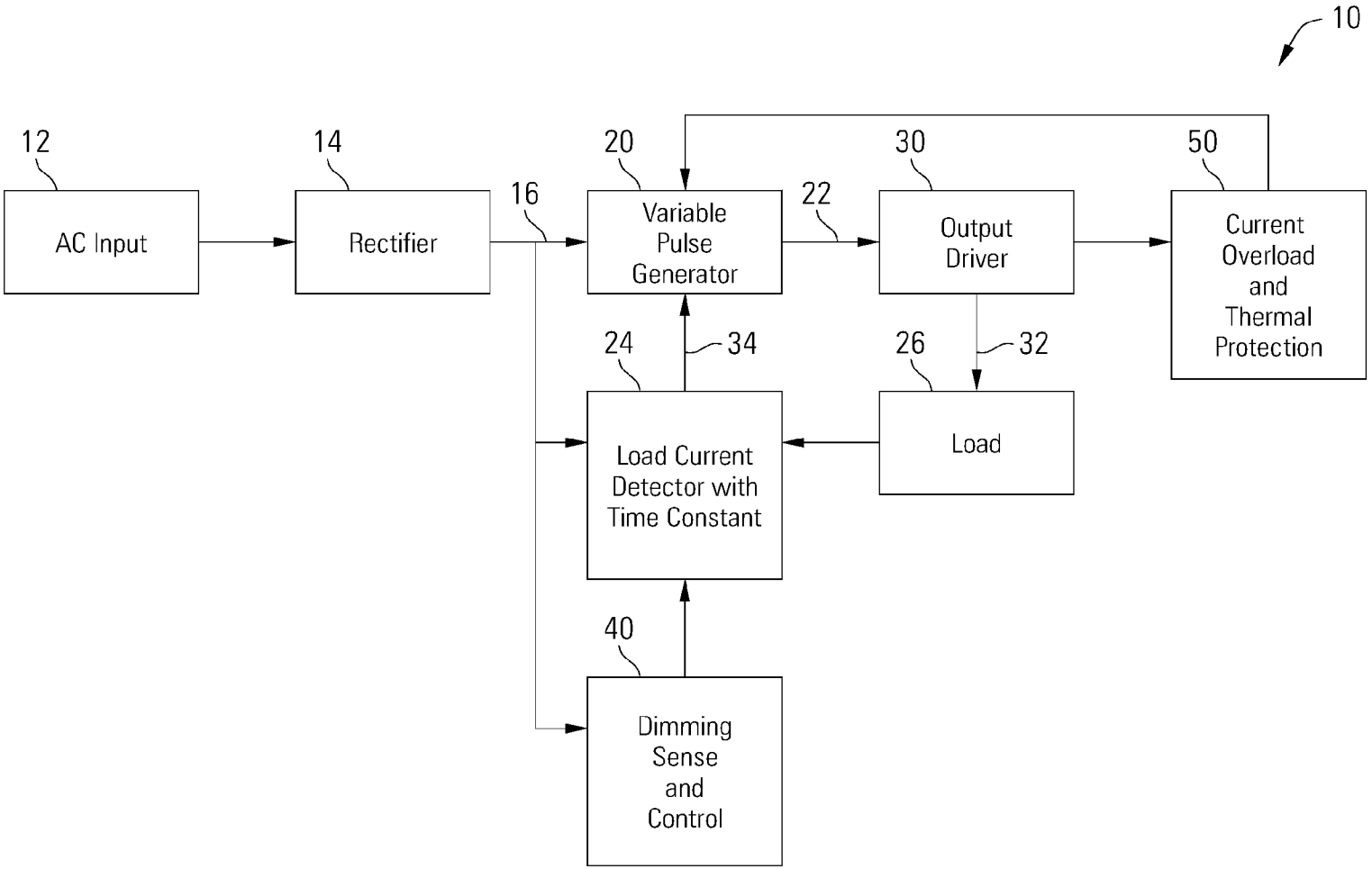
FIG. 4 depicts a block diagram of a dimmable power supply with internal dimming and current overload and thermal protection.

Elements of the various embodiments disclosed herein may be included or omitted as desired. For example, in the block diagram of FIG. 4, a dimmable power supply 10 is disclosed that includes both the internal dimmer 40 and the current overload protection the thermal protection 50.

Figure 5:
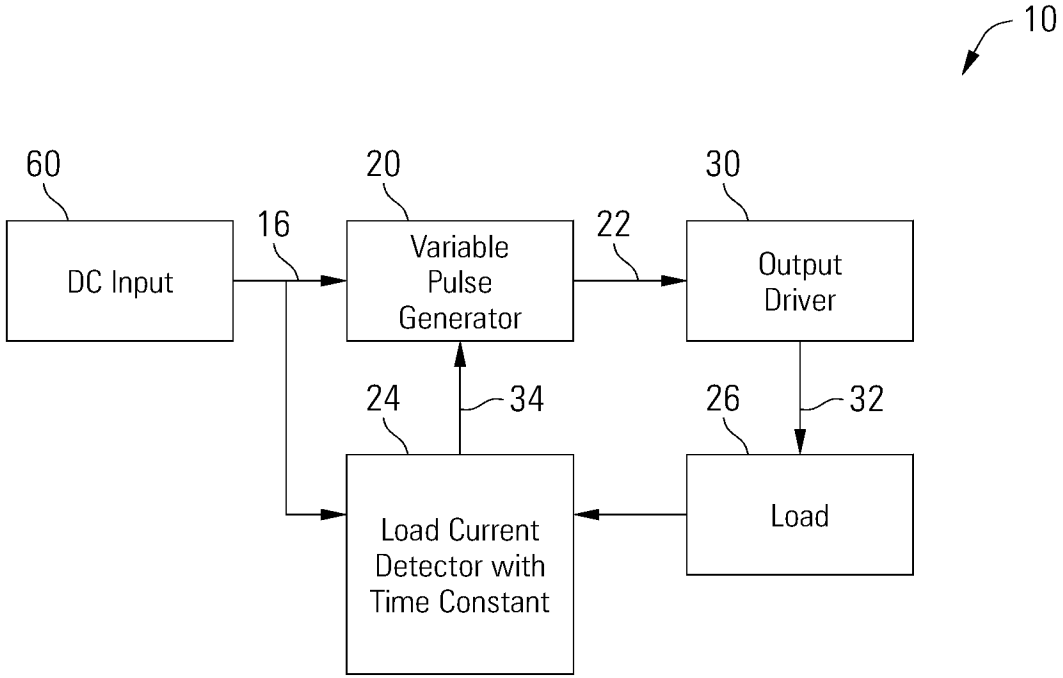
FIG. 5 depicts a block diagram of a dimmable power supply with a DC input.

As discussed above, the dimmable power supply 10 may be powered by any suitable power source, such as the AC input 12 and rectifier 14 of FIG. 1, or a DC input 60 as illustrated in FIG. 5. Time constants in the dimmable power supply 10 are adapted to produce pulses in the output 22 of the variable pulse generator 20 having a constant width across the input voltage waveform from a rectified AC input 12, thereby maintaining a good power factor, while still being able to compensate for slower changes in the input voltage to provide a constant load current.

Figure 6:
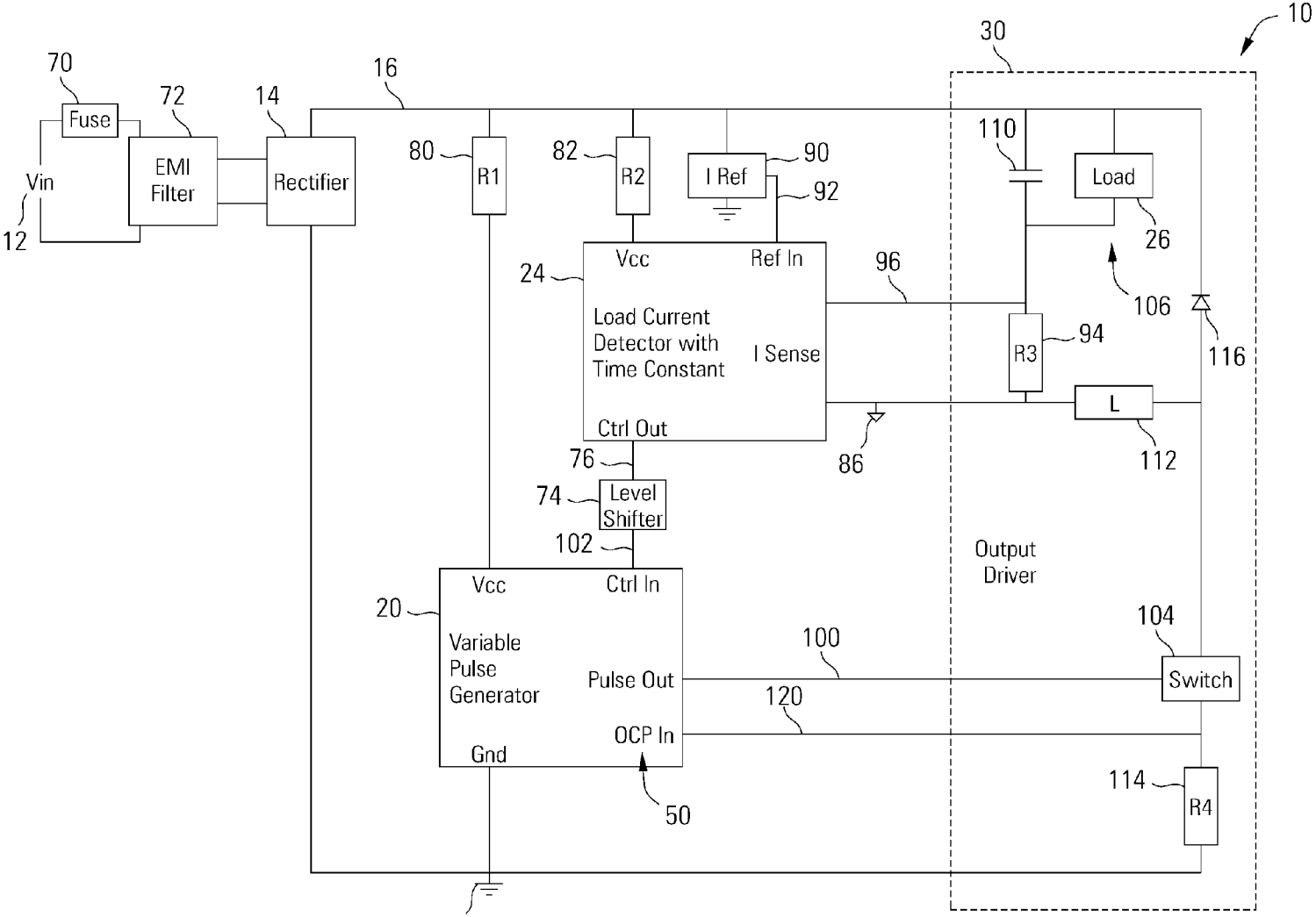
FIG. 6 depicts a block diagram of a dimmable power supply in accordance with some embodiments.

Referring now to FIG. 6, the dimmable power supply 10 will be described in more detail. In the diagram of FIG. 6, the load 26 is shown inside the output driver 30 for convenience in setting forth the connections in the diagram. An AC input 12 is shown, and is connected to the dimmable power supply 10 in this embodiment through a fuse 70 and an electromagnetic interference (EMI) filter 72. The fuse 70 may be any device suitable to protect the dimmable power supply 10 from overvoltage or overcurrent conditions, such as a traditional meltable fuse or other device (e.g., a small low power surface mount resistor), a breaker, etc. The EMI filter 72 may be any device suitable to prevent EMI from passing into or out of the dimmable power supply 10, such as a coil, inductor, capacitor and/or any combination of these, or, also in general, a filter, etc. The AC input 12 is rectified in a rectifier 14 as discussed above. In other embodiments, the dimmable power supply 10 may use a DC input as discussed above. In this embodiment, the dimmable power supply 10 may generally be divided into a high side portion including the load current detector 24 and a low side portion including the variable pulse generator 20, with the output driver 30 spanning or including the high and low side. In this case, a level shifter 74 may be employed between the load current detector 24 in the high side and the variable pulse generator 20 in the low side to communicate the control signal 76 to the variable pulse generator 20. The variable pulse generator 20 and load current detector 24 are both powered by the power output 16 of the rectifier 14, for example through resistors 80 and 82, respectively. The high side, including the load current detector 24, floats at a high potential under the voltage of the input voltage 16 and above the circuit ground 84. A local ground 86 is thus established and used as a reference voltage by the load current detector 24.

A reference current source 90 supplies a reference current signal 92 to the load current detector 24, and a current sensor such as a resistor 94 provides a load current signal 96 to the load current detector 24. The reference current source 90 may use the circuit ground 84 as illustrated in FIG. 6, or the local ground 86, or both, or some other reference voltage level as desired. The load current detector 24 compares the reference current signal 92 with the load current signal 96 using a time constant to effectively average out and disregard current fluctuations due to any waveform at the input voltage 16 and pulses from the variable pulse generator 20, and generates the control signal 76 to the variable pulse generator 20. The variable pulse generator 20 adjusts the pulse width of a train of pulses at the pulse output 100 of the variable pulse generator 20 based on the level shifted control signal 102 from the load current detector 24. The level shifter 74 shifts the control signal 76 from the load current detector 24 which is referenced to the local ground 86 in the load current detector 24 to a level shifted control signal 102 that is referenced to the circuit ground 84 for use in the variable pulse generator 20. The level shifter 74 may comprise any suitable device for shifting the voltage of the control signal 76, such as an opto-isolator or opto-coupler, resistor, transformer, etc.

The pulse output 100 from the variable pulse generator 20 drives a switch 104 such as a field effect transistor (FET) in the output driver 30. When a pulse from the variable pulse generator 20 is active, the switch 104 is turned on, drawing current from the input voltage 16, through the load path 106 (and an optional capacitor 110 connected in parallel with the load 26), through the load current sense resistor 94, an inductor 112 in the output driver 30, the switch 104, and a current sense resistor 114 to the circuit ground 84. When the pulse from the variable pulse generator 20 is off, the switch 104 is turned off, blocking the current from the input voltage 16 to the circuit ground 84. The inductor 112 resists the current change and recirculates current through a diode 116 in the output driver 30, through the load path 106 and load current sense resistor 94 and back to the inductor 112. The load path 106 is thus supplied with current alternately through the switch 104 when the pulse from the variable pulse generator 20 is on and with current driven by the inductor 112 when the pulse is off. The pulses from the variable pulse generator 20 have a relatively much higher frequency than variations in the input voltage 16, such as for example 30 kHz or 100 kHz as compared to the 100 Hz or 120 Hz that may appear on the input voltage 16 from the rectified AC input 12. Note that any suitable frequency for the pulses from the variable pulse generator 20 may be selected as desired, with the time constant in the load current detector 24 being selected accordingly to disregard load current changes due to the pulses from the variable pulse generator 20 while tracking changes on the input voltage 16 that are slower than or on the order of the waveform on the input voltage 16. Changes in the current through the load 26 due to the pulses from the variable pulse generator 20 may be smoothed in the optional capacitor 110, or may be ignored if the load is such that high frequency changes are acceptable. For example, if the load 26 is an LED or array of LEDs, any flicker that may occur due to pulses at many thousands of cycles per second will not be visible to the eye. In the embodiment of FIG. 6, a current overload protection 50 is included in the variable pulse generator 20 and is based on a current measurement signal 120 by the current sense resistor 114 connected in series with the switch 104. If the current through the switch 104 and the current sense resistor 114 exceeds a threshold value set in the current overload protection 50, the pulse width at the pulse output 100 of the variable pulse generator 20 will be reduced or eliminated. The present invention is shown implemented in the discontinuous mode; however with appropriate modifications operation under continuous or critical conduction modes can also be realized.

Figure 7:
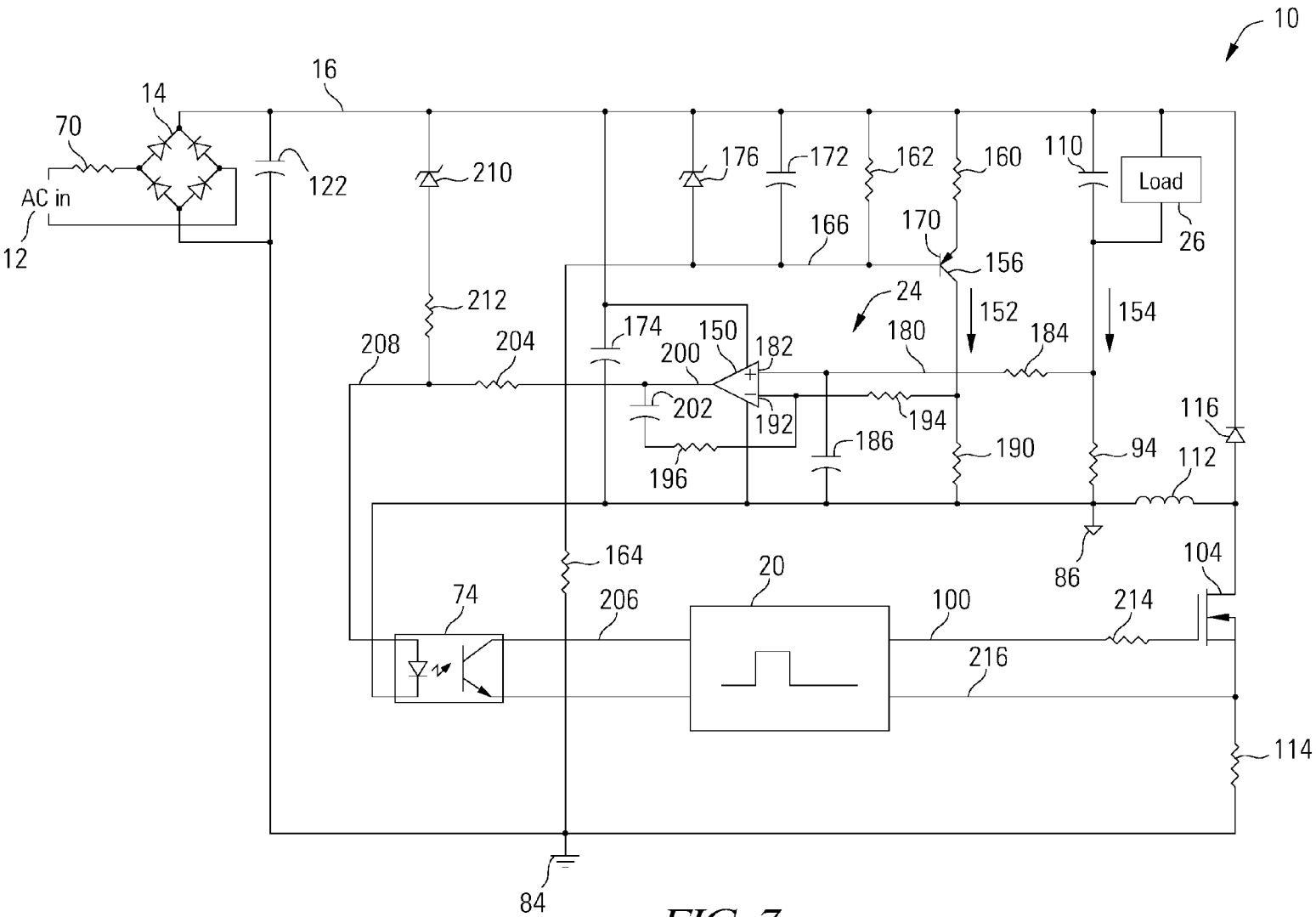
FIG. 7 depicts a schematic of a dimmable power supply in accordance with some embodiments.

Referring now to FIG. 7, a schematic of one embodiment of the dimmable power supply 10 will be described. In this embodiment, an AC input 12 is used, with a resistor included as a fuse 70, and a diode bridge as a rectifier 14. Some smoothing of the input voltage 16 may be provided by a capacitor 122, although it is not necessary as described above. A variable pulse generator 20 is used to provide a stream of pulses at the pulse output 100. As described above, the variable pulse generator 20 may be embodied in any suitable device or circuit for generating a stream of pulses. Those pulses may have any suitable shape, such as substantially square pulses, semi-sinusoidal, triangular, etc. although square or rectangular are the most common in driving field effect transistors. The frequency of the pulses may also be set at any desired level, such as 30 kHz or 100 kHz, that enable the load current detector 24 to disregard changes in a load current due to the pulses input waveform and also realize a very high power factor approaching unity. The width of the pulses is controlled by the load current detector 24, although a maximum width may be established if desired. For example, in one embodiment, the maximum pulse width is set at about one tenth of a pulse cycle. This may be interpreted from one point of view as a 10 percent duty cycle at maximum pulse width. However, the dimmable power supply 10 is not limited to any particular maximum pulse width.

The variable pulse generator 20 is powered from the input voltage 16 by any suitable means. Because a wide range of known methods of reducing or regulating a voltage are known, the power supply for the variable pulse generator 20 from the input voltage 16 is not shown in FIG. 7. For example, a voltage divider or a voltage regulator may be used to drop the voltage from the input voltage 16 down to a useable level for the variable pulse generator 20.

In one particular embodiment illustrated in FIG. 7, the load current detector 24 includes an operational amplifier (op-amp) 150 acting as an error amplifier to compare a reference current 152 and a load current 154. The op-amp 150 may be embodied by any device suitable for comparing the reference current 152 and load current 154, including active devices and passive devices. The op-amp 150 is referred to herein generically as a comparator, and the term comparator should be interpreted as including and encompassing any device, including active and passive devices, for comparing the reference current 152 and load current 154. The reference current 152 may be supplied by a transistor such as bipolar junction transistor (BJT) 156 connected in series with resistor 160 to the input voltage 16. A resistor 162 and a resistor 164 are connected in series between the input voltage 16 and the circuit ground 84, forming a voltage divider with a central node 166 connected to the base 170 of the BJT 156. The BJT 156 and resistor 160 act as a constant current source that is varied by the voltage on the central node 166 of the voltage divider 162 and 164, which is in turn dependent on the input voltage 16. A capacitor 172 may be connected between the input voltage 16 and the central node 166 to form a time constant for voltage changes at the central node 166. The dimmable power supply 10 thus responds to the average voltage of input voltage 16 rather than the instantaneous voltage. In one particular embodiment, the local ground 86 floats at about 10 V below the input voltage 16 at a level established by the load 26. A capacitor 174 may be connected between the input voltage 16 and the local ground 86 to smooth the voltage powering the load current detector 24 if desired. A Zener diode 176 may also be connected between the input voltage 16 and the central node 166 to set a maximum load current 154 by clamping the reference current that BJT 156 can provide to resistor 190. In other embodiments, the load current detector 24 may have its current reference derived by a simple resistive voltage divider, with suitable AC input voltage sensing, level shifting, and maximum clamp, rather than BJT 156.

The load current 154 (meaning, in this embodiment, the current through the load 26 and through the capacitor 110 connected in parallel with the load 26) is measured using the load current sense resistor 94. The capacitor 110 can be configured to either be connected through the sense resistor 94 or bypass the sense resistor 94. The current measurement 180 is provided to an input of the error amplifier 150, in this case, to the non-inverting input 182. A time constant is applied to the current measurement 180 using any suitable device, such as the RC lowpass filter made up of the series resistor 184 and the shunt capacitor 186 to the local ground 86 connected at the non-inverting input 182 of the error amplifier 150. As discussed above, any suitable device for establishing the desired time constant may be used such that the load current detector 24 disregards rapid variations in the load current 154 due to the pulses from the variable pulse generator 20 and any regular waveform of the input voltage 16. The load current detector 24 thus substantially filters out changes in the load current 154 due to the pulses, averaging the load current 154 such that the load current detector output 200 is substantially unchanged by individual pulses at the variable pulse generator output 100.

The reference current 152 is measured using a sense resistor 190 connected between the BJT 156 and the local ground 86, and is provided to another input of the error amplifier 150, in this case, the inverting input 192. The error amplifier 150 is connected as a difference amplifier with negative feedback, amplifying the difference between the load current 154 and the reference current 152. An input resistor 194 is connected in series with the inverting input 192 and a feedback resistor 196 is connected between the output 200 of the error amplifier 150 and the inverting input 192. A capacitor 202 is connected in series with the feedback resistor 196 between the output 200 of the error amplifier 150 and the inverting input 192 and an output resistor 204 is connected in series with the output 200 of the error amplifier 150 to further establish a time constant in the load current detector 24. Again, the load current detector 24 may be implemented in any suitable manner to measure the difference of the load current 154 and reference current 152, with a time constant being included in the load current detector 24 such that changes in the load current 154 due to pulses are disregarded while variations in the input voltage 16 other than any regular waveform of the input voltage 16 are tracked.

The output 200 from the error amplifier 150 is connected to the level shifter 74, in this case, an opto-isolator, through the output resistor 204 to shift the output 200 from a signal that is referenced to the local ground 86 to a signal 206 that is referenced to the circuit ground 84 or to another internal reference point in the variable pulse generator 20. A Zener diode 210 and series resistor 212 may be connected between the input voltage 16 and the input 208 of the level shifter 74 for overvoltage protection. If the voltage across load 26 rises excessively, the Zener diode 210 will conduct, turn on the level shifter 74 and reduce the pulse width or stop the pulses from the variable pulse generator 20. There are thus two parallel control paths, the error amplifier 150 to the level shifter 74 and the overvoltage protection Zener diode 210 to the level shifter 74.

The error amplifier 150 operates in an analog mode. During operation, as the load current 154 rises above the reference current 152, the voltage at the output 200 of the error amplifier 150 increases, causing the variable pulse generator 20 to reduce the pulse width or stop the pulses from the variable pulse generator 20. As the output 200 of the error amplifier 150 rises, the pulse width becomes narrower and narrower until the pulses are stopped altogether from the variable pulse generator 20. The error amplifier 150 produces an output proportional to the difference between the average load current 154 and the reference current 152, where the reference current 152 is proportional to the average input voltage 16.

As discussed above, pulses from the variable pulse generator 20 turn on the switch 104, in this case a power FET via a resistor 214 to the gate of the FET 104. This allows current 154 to flow through the load 26 and capacitor 110, through the load current sense resistor 94, the inductor 112, the switch 104 and current sense resistor 114 to circuit ground 84. In between pulses, the switch 104 is turned off, and the energy stored in the inductor 112 when the switch 104 was on is released to resist the change in current. The current from the inductor 112 then flows through the diode 116 and back through the load 26 and load current sense resistor 94 to the inductor 112. Because of the time constant in the load current detector 24, the load current 154 monitored by the load current detector 24 is an average of the current through the switch 104 during pulses and the current through the diode 116 between pulses.

The current through the dimmable power supply 10 is monitored by the current sense resistor 114, with a current feedback signal 216 returning to the variable pulse generator 20. If the current exceeds a threshold value, the pulse width is reduced or the pulses are turned off in the variable pulse generator 20. Generally, current sense resistors 94 and 114 may have low resistance values in order to sense the currents without substantial power loss. Thermal protection may also be included in the variable pulse generator 20, narrowing or turning off the pulses if the temperature climbs or if it reaches a threshold value, as desired. Thermal protection may be provided in the variable pulse generator 20 in any suitable manner, such as using active temperature monitoring, or integrated in the overcurrent protection by gating a BJT or other such suitable devices, switches and/or transistors with the current feedback signal 216, where, for example, the BJT exhibits negative temperature coefficient behavior. In this case, the BJT would be easier to turn on as it heats, making it naturally start to narrow the pulses.

In one particular embodiment the load current detector 24 turns on the output 200 to narrow or turn off the pulses from the variable pulse generator 20, that is, the pulse width is inversely proportional to the load current detector output 200. In other embodiments, this control system may be inverted so that the pulse width is directly proportional to the load current detector output 200. In these embodiments, the load current detector 24 is turned on to widen the pulses.

Figure 8:
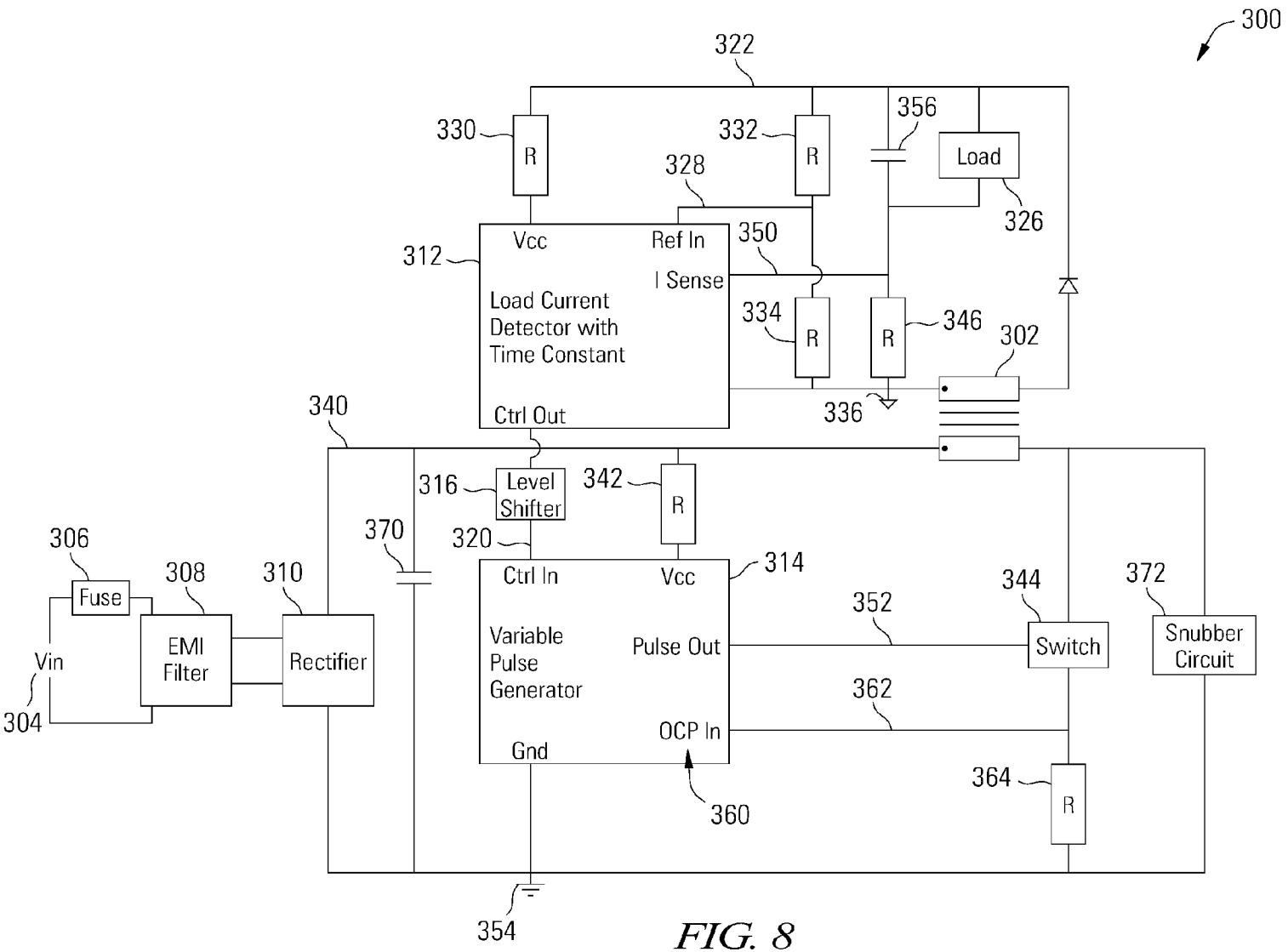
FIG. 8 depicts a depicts a schematic of a power supply with a transformer for isolation in flyback mode in accordance with some embodiments.
Figure 9:
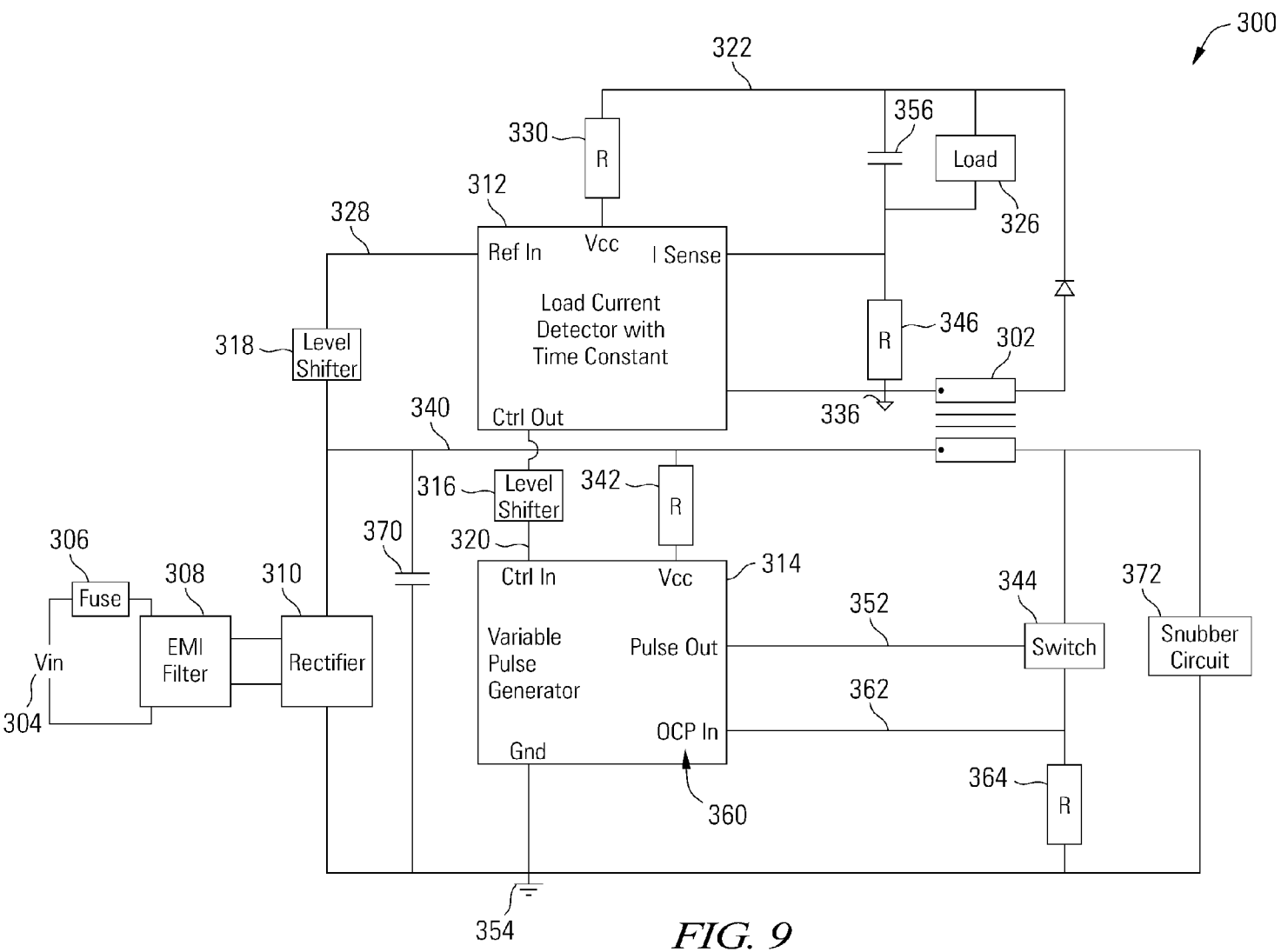
FIG. 9 depicts a depicts a schematic of a dimmable power supply with a transformer for isolation in flyback mode in accordance with some embodiments.

In applications where it is useful or desired to have isolation between the load and the input voltage source, a transformer can be used in place of the inductor. The transformer can be of essentially any type including toroidal, C or E cores, or other core types and, in general, should be designed for low loss. The transformer can have a single primary and a single secondary coil or the transformer can have either multiple primaries and/or secondaries or both. FIG. 8 illustrates one embodiment using a transformer in the flyback mode of operation to realize a highly efficient circuit with very high power factor approaching unity and with isolation between the AC input and the LED output. Such an embodiment can also readily support internal dimming as illustrated in FIG. 9.

Referring now to FIG. 8, a non-dimming power supply 300 with a transformer 302 will be described. An AC input 304 is shown, and is connected to the dimmable power supply 300 in this embodiment through a fuse 306 and an electromagnetic interference (EMI) filter 308. As in previously described embodiments, the fuse 306 may be any device suitable to protect the dimmable power supply 300 from overvoltage or overcurrent conditions. The AC input 304 is rectified in a rectifier 310. In other embodiments, the dimmable power supply 300 may use a DC input. The dimmable power supply 300 may generally be divided into a high side portion including the load current detector 312 and a low side portion including the variable pulse generator 314. The high side portion is connected to one side of the transformer 302, such as the secondary winding, and the low side portion is connected to the other side of the transformer 302, such as the primary winding. A level shifter 316 is employed between the load current detector 312 in the high side and the variable pulse generator 314 in the low side to communicate the control signal 320 to the variable pulse generator 314. The high side has a node that may be considered a power input 322 for the output driver, although the power for the power input 322 is derived in this embodiment from the transformer 302. The load 326 receives power from the power input 322. The load current detector 312 is also powered from the power input 322 through a resistor 330, and a reference current 328 for the load current detector 312 is generated by a voltage divider having resistors 332 and 334 connected in series between the power input 322 and a high side or local ground 336. The variable pulse generator 314 is powered from a low side input voltage 340 through a resistor 342, and a switch 344 driven by pulses from the variable pulse generator 314 turns on and off current through the transformer 302. The power supply voltage to the load current detector 312 may be regulated in any suitable manner, and the reference current input 328 may be stabilized as desired. For example, a voltage divider with a clamping Zener diode may be used as in previous embodiments, a precision current source may be used in place of the resistor 332 in the voltage divider, a bandgap reference source may be used, etc. Note that it is important in dimmable embodiments for the input voltage 340 to be a factor in the reference current input 328 such that this input 328 is clamped at some maximum value as the input voltage 340 rises, yet is allowed to fall as input voltage 340 drops (suitably filtered to reject the AC line frequency).

In the high side, as current flows through the load 326, a load current sense resistor 346 provides a load current feedback signal 350 to the load current detector 312. The load current detector 312 compares the reference current signal 328 with the load current signal 350 using a time constant to effectively average out and disregard current fluctuations due to any waveform at the power input 322 and pulses from the variable pulse generator 314 through the transformer 302, and generates the control signal 320 to the variable pulse generator 314. The variable pulse generator 314 adjusts the pulse width of a train of pulses at the pulse output 352 of the variable pulse generator 314 based on the level shifted control signal 320 from the load current detector 312. The level shifter 316 shifts the control signal 320 from the load current detector 312 which is referenced to the local ground 336 by the load current detector 312 to a level shifted control signal that is referenced to the circuit ground 354 for use by the variable pulse generator 314. The level shifter 316 may comprise any suitable device for shifting the voltage of the control signal 320 between isolated circuit sections, such as an opto-isolator, opto-coupler, resistor, transformer, etc.

The pulse output 352 from the variable pulse generator 314 drives the switch 344, allowing current to flow through the transformer 302 and powering the high side portion of the dimmable power supply 300. As in some other embodiments, any suitable frequency for the pulses from the variable pulse generator 314 may be selected, with the time constant in the load current detector 312 being selected to disregard load current changes due to the pulses from the variable pulse generator 312 while tracking changes on the input voltage 322 that are slower than or on the order of the waveform on the input voltage 322. Changes in the current through the load 326 due to the pulses from the variable pulse generator 314 may be smoothed in the optional capacitor 356, or may be ignored if the load is such that high frequency changes are acceptable. Current overload protection 360 may be included in the variable pulse generator 314 based on a current measurement signal 362 by a current sense resistor 364 connected in series with the switch 344. If the current through the switch 344 and the current sense resistor 364 exceeds a threshold value set in the current overload protection 360, the pulse width at the pulse output 352 of the variable pulse generator 314 will be reduced or eliminated. A line capacitor 370 may be included between the input voltage 340 and circuit ground 354 to smooth the rectified input waveform if desired. A snubber circuit 372 may be included in parallel, for example, with the switch 344 if desired to suppress transient voltages in the low side circuit. It is important to note that the dimmable power supply 300 is not limited to the flyback mode configuration illustrated in FIG. 8, and that a transformer or inductor based dimmable power supply 300 may be arranged in any desired topology.

Referring now to FIG. 9, the power supply 300 with a transformer 302 may be adapted for dimmability by providing level-shifted feedback from the AC input voltage 340 to the load current detector 312. The level shifter 318 may comprise any suitable device as with other level shifters (e.g., 316). The level-shifted feedback enables the load current detector 312 to sense the AC input voltage 340 so that it can provide a control signal 320 that is proportional to the dimmed AC input voltage 340.

Figure 10:
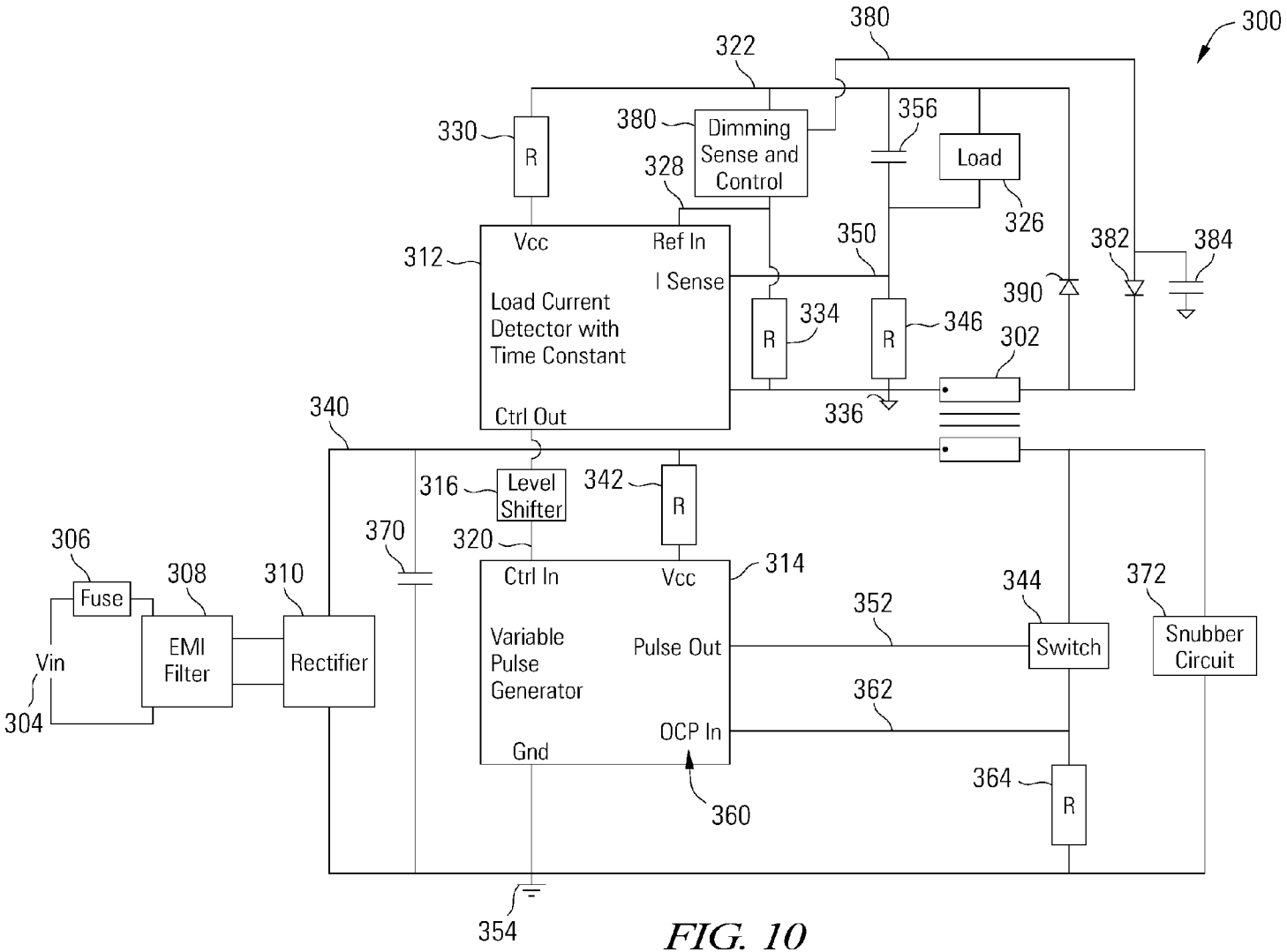
FIG. 10 depicts a depicts a schematic of a dimmable power supply with a transformer for isolation in accordance with some embodiments.

Referring now to FIG. 10, the dimmable power supply 300 may also include an internal dimmer 380, for example, to adjustably attenuate any of a number of reference or feedback currents. In the embodiment of FIG. 9, the dimmable power supply 300 is placed to adjustable control the level of the reference current 328. The reference current 328 generated by the internal dimmer 380 may be based on the input voltage 340 in the low side or primary side of the dimmable power supply 300 via a feedback signal 380 through the transformer 302. Diode 382 may be included to ensure that current on the internal dimmer 380 flows only in one direction, and capacitor 384 may be added to introduce a time constant on the internal dimmer 380. For example, referring to FIGS. 7 and 10 simultaneously, if the high side of the dimmable power supply 300 of FIG. 9 were configured similar to that of the dimmable power supply 10 of FIG. 7, the bottom of resistor 164 may be connected to the internal dimmer 380 rather than to the circuit ground 84. Note also that diode 390 may not be needed if the dimmable power supply 300 is not configured for operation in flyback mode.

Figure 11:
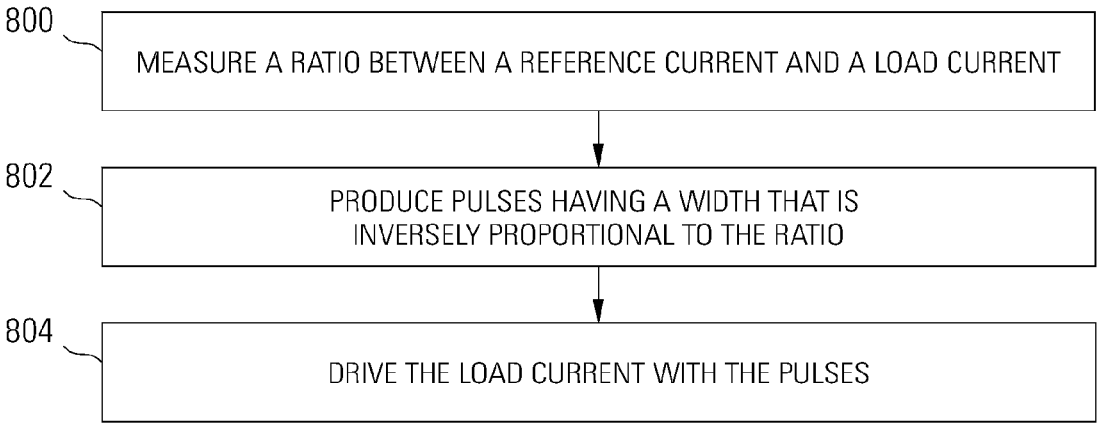
FIG. 11 depicts a flow chart of a method of dimmably supplying a load current in accordance with some embodiments.

Turning now to FIG. 11, one embodiment of a method for dimmably supplying a load current is summarized. The method includes measuring a ratio between a reference current 152 and a load current 154 (block 800), producing pulses having a width that is inversely proportional to the ratio (block 802), and driving the load current with the pulses (block 804. As described above, the measuring is performed with a time constant that substantially filters out the pulses in the load current 154 but substantially passes changes in the reference current 152. Note, however, that a time constant is applied to the reference current 152 as well, thereby considering an average input voltage 16 rather than instantaneous. The time constant applied to the reference current 152 may be varied as desired, however, to maintain a high power factor the pulse width should be constant across an input waveform on the input voltage 16. In some embodiments, the pulse width is kept substantially constant across a cycle of the input voltage waveform. Given the feedback and control of the dimmable power supply 10 and 300, there may be changes in the pulse width across a cycle of an input waveform when the load current is being held constant despite noise on the input voltage, or when the load current is being varied by an external or internal dimmer. The statement that the pulse width will be kept substantially constant across a cycle of the input waveform does not preclude these changes to the pulse width that may occur partially or entirely across a cycle of the input waveform, but indicates in these embodiments that the pulse width is not substantially varied in direct response to the rising and falling input voltage due to the waveform itself, such as to the half sinusoidal peaks of a rectified AC waveform.

The dimmable power supply 10 disclosed herein provides an efficient way to power loads such as LEDs with a good power factor, while remaining dimmable by external or internal devices.

While illustrative embodiments have been described in detail herein, it is to be understood that the concepts disclosed herein may be otherwise variously embodied and employed. The configuration, arrangement and type of components in the various embodiments set forth herein are illustrative embodiments only and should not be viewed as limiting or as encompassing all possible variations that may be performed by one skilled in the art while remaining within the scope of the claimed invention.

What is claimed is:

1. A power supply comprising:

a power input;

a load output;

a power control switch operable to control a flow of current from the power input;

a variable pulse generator operable to control the power control switch;

an inductor connected to the load output, operable to store energy from the power input when the power control switch is on and to release energy to the load output when the power control switch is off; and a load current detector operable to detect a current to the load output and to control a pulse width from the variable pulse generator based at least in part on the current to the load output, wherein the load current detector has a time constant operable to substantially filter out a change in the current to the load output at a frequency of the variable pulse generator, wherein the load output, the inductor and the power control switch are connected in series to the power input.

2. The power supply of claim 1, further comprising a diode connected in parallel with the load output and the inductor.

3. The power supply of claim 1, further comprising a load current detection resistor connected in series with the load output, wherein the load current detector is operable to detect the current to the load output based at least in part on a voltage across the load current detection resistor.

4. The power supply of claim 3, wherein the load current detector is operable to control the pulse width from the variable pulse generator based at least in part on a reference signal proportional to a voltage at the power input.

5. A power supply comprising:

a power input;

a load output;

a power control switch operable to control a flow of current from the power input;

a variable pulse generator operable to control the power control switch;

an inductor connected to the load output, operable to store energy from the power input when the power control switch is on and to release energy to the load output when the power control switch is off;

a load current detector operable to detect a current to the load output and to control a pulse width from the variable pulse generator based at least in part on the current to the load output, wherein the load current detector has a time constant operable to substantially filter out a change in the current to the load output at a frequency of the variable pulse generator; and wherein the inductor comprises a transformer having a first winding connected to the power input and the power control switch and having a second winding connected to the load output.

6. The power supply of claim 5, further comprising a diode connected in series with the load output and the second winding.

7. The power supply of claim 6, further comprising a current sense resistor connected in series with the load output, the diode and the second winding.

8. The power supply of claim 7, wherein the load current detector is operable to detect the current to the load output based on a voltage across the current sense resistor.

9. The power supply of claim 8, wherein the load current detector is operable to control the pulse width from the variable pulse generator based at least in part on a reference current.

10. The power supply of claim 9, further comprising a reference current source operable to generate the reference current based on a voltage of the second winding.

11. The power supply of claim 9, further comprising a reference current source operable to generate the reference current based on a voltage of the power input.

12. The power supply of claim 11, further comprising a level shifter between the power input and the reference current source.

13. The power supply of claim 5, further comprising a dimming control circuit connected to the load current detector and operable to generate a reference current for the dimming control circuit, and wherein the dimming control circuit is controllable to set a dimming level to control the current to the load output.

14. The power supply of claim 13, wherein the dimming control circuit is operable to control the pulse width from the variable pulse generator based at least in part on the reference current from the dimming control circuit.

15. The power supply of claim 13, further comprising a capacitor connected to the dimming control circuit, whereby a time constant is applied to the dimming control circuit.

16. A power supply comprising:

a power input;

a load output;

a power control switch operable to control a flow of current from the power input;

a variable pulse generator operable to control the power control switch;

an inductor connected to the load output, operable to store energy from the power input when the power control switch is on and to release energy to the load output when the power control switch is off;

a load current detector operable to detect a current to the load output and to control a pulse width from the variable pulse generator based at least in part on the current to the load output, wherein the load current detector has a time constant operable to substantially filter out a change in the current to the load output at a frequency of the variable pulse generator; and a snubber circuit connected in parallel with the power control switch.

* * * * *